United States Patent [19]

Inka

[11] 3,971,280

[45] July 27, 1976

[54] TAPE DISPENSER

[75] Inventor: Egons Inka, Chicago, Ill.

[73] Assignee: Crane Packing Company, Morton Grove, Ill.

[22] Filed: Nov. 6, 1975

[21] Appl. No.: 629,271

[52] U.S. Cl. ..... 83/436; 83/444; 83/611; 83/649; 225/15; 225/16; 225/54

[51] Int. Cl.[2] ..... B26D 1/38; B26D 5/10

[58] Field of Search ..... 83/436, 444, 446, 611, 83/649; 225/14, 15, 16, 54, 90

[56] References Cited

UNITED STATES PATENTS

| | | | |
|---|---|---|---|
| 1,805,619 | 5/1931 | Fuller | 83/649 X |
| 3,001,284 | 9/1961 | Marotz | 83/649 X |
| 3,470,781 | 10/1969 | Domeny | 83/611 X |
| 3,896,691 | 7/1975 | Granger et al. | 83/649 X |

*Primary Examiner*—Frank T. Yost
*Attorney, Agent, or Firm*—Charles F. Voytech

[57] ABSTRACT

A tape container and dispensing apparatus formed of plastic material including means for advancing the tape to dispense a strip of any desired length and integrally formed shearing means to provide scissors-like shearing action to sever the tape strip.

10 Claims, 7 Drawing Figures

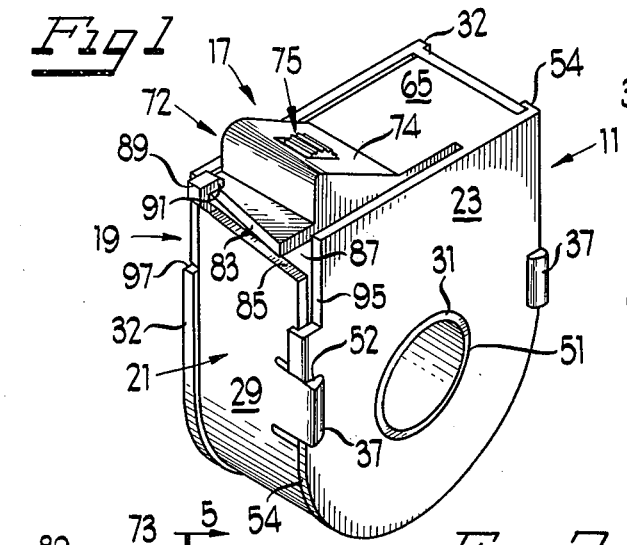
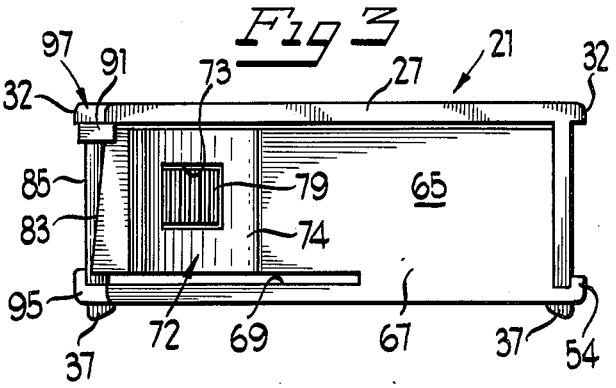
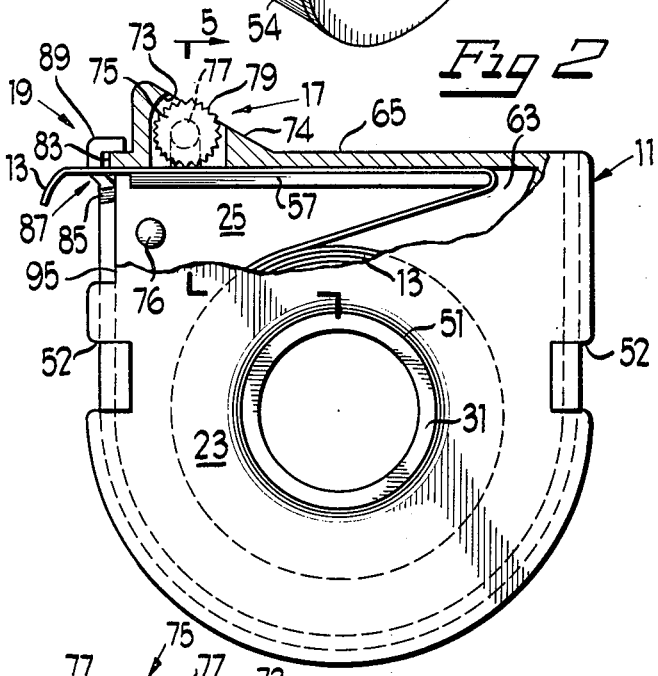
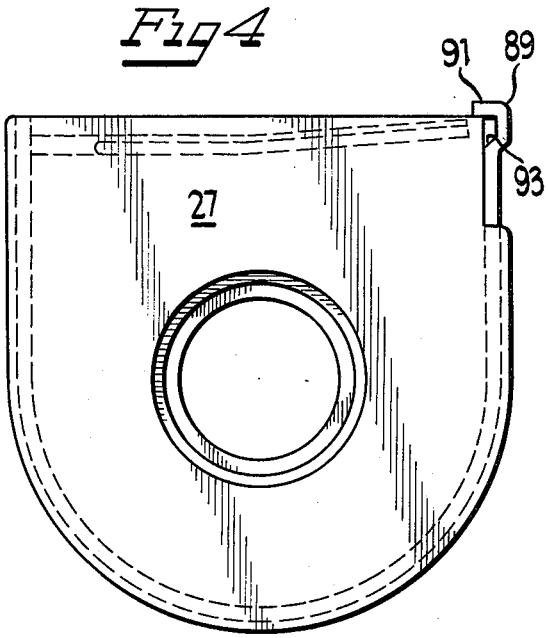
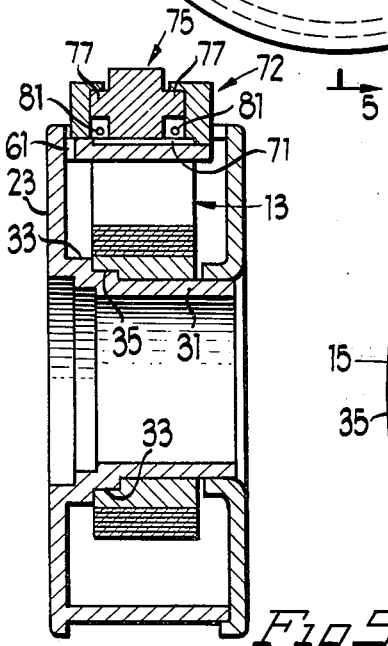
Fig 5
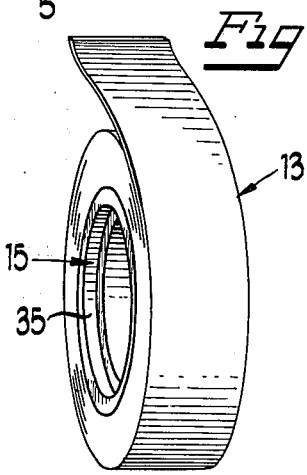
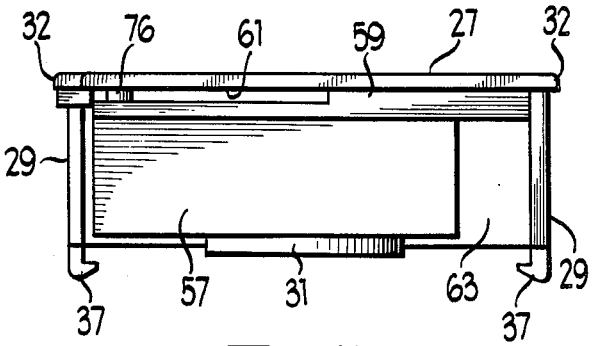
Fig 6

TAPE DISPENSER

BACKGROUND OF THE INVENTION

This invention relates to dispensers for tape or other ribbon like material. More particularly it relates to dispensers which include means for advancement of the dispensed material as well as integrally formed cut-off means.

Various forms of resilient elastomeric tape are in common usage. One such tape is unsintered polytetrafluoroethylene tape sold under the trade-mark "Teflon" by duPont de Nemours Company, Wilmington, Delaware. Such tape may be a few thousandths of an inch in thickness. It is particularly suitable for sealing threaded joints of pipe or conduit. It posesses a very low modulus of elasticity and is difficult to tear or rip. Other forms of tape possessing similar characteristics include electrical and surgical tapes formed of polomeric hydrocarbons.

Tape dispensers have been utilized in the past to dispense cut lengths of tape of the type described above. Examples of such prior dispensers are disclosed in U.S. Pat. Nos. 3,050,853; 3,067,514; 3,102,671; and 3,470,781.

In each of the above prior dispensers metal components are utilized in the cutting mechanism which severs the tape strip.

In some of the prior designs the metal cutting mechanism attached to the tape dispenser is extremely complicated and comprises a relatively expensive element. Because of the properties of the tape being severed, these cutting elements are substantially more involved than warranted for the purpose served.

In others such as that shown in U.S. Pat. No. 3,102,621 it is necessary that a razor sharp cutting edge be maintained to accomplish cutting of the tape strip. Once the edge is lost, the cutting mechanism is ineffective.

It is the principal object of the present invention to provide an improved type of tape dispenser for tape of low elastic modulus which includes means for advancement of the tape and which includes integrally formed shearing means to provide scissors-like shearing action to sever the tape strip.

SUMMARY OF THE INVENTION

Very generally the present invention is directed to a tape container or dispenser for polymeric tape in strip form contained upon a roll. The dispenser includes a chamber defining housing and an advancement arrangement adapted to operatively engage the tape strip to advance it out of the chamber upon manual manipulation. The dispenser includes integrally formed cutting means defining cooperating cutting surfaces operable to provide an advancing point contact shearing action transversely across the strip to sever a length of tape from the stored supply.

DESCRIPTION OF THE DRAWINGS

FIG. 1 is a perspective view of a tape dispenser embodying the principles of the present invention;

FIG. 2 is a front elevational view partially broken away and partly in section of the tape dispenser of FIG. 1;

FIG. 3 is a top view of the tape dispenser of FIG. 1;

FIG. 4 is a rear elevational view of the body portion of the tape dispenser of FIG. 1;

FIG. 5 is a sectional view of the tape dispenser of FIG. 1 taken generally along lines 5—5 of FIG. 2;

FIG. 6 is a top view of the body portion of the dispenser of FIG. 1;

FIG. 7 is a perspective view of a roll of tape for the dispenser of FIG. 1.

DETAILED DESCRIPTION

Referring now to the drawings there is illustrated a tape dispenser embodying the principles of the present invention.

Specifically, and as seen in FIGS. 1 and 2, there is shown a tape dispenser 11 adapted to house a quantity of tape 13 in the form of a continuous strip rolled upon a spool 15. The tape 13 may be unsintered polytetrafluoroethylene or other elastomeric material of low elastic modulus. Such tape, due to its physical properties, is difficult to sever by tearing or ripping.

The dispenser 11 includes an advancement arrangement 17 operable to advance a strip of tape from the dispenser. It further includes a shearing mechanism 19 integrally formed in the dispenser to effect severance of a strip of tape from the rolled supply.

The dispenser 11 includes two separate elements, a body 21 and a cover 23 which are releasably connected to define a tape receiving chamber 25. The cover is removable to replace the tape supply. These two elements 21 and 23 additionally include integrally formed components of the advancement arrangement 17 and shearing mechanism 19.

Each of the body 21 and cover 23 are formed of a plastic material and may be molded by any suitable means. A material found to be satisfactory for use in these dispenser components is a polymeric elastomer sold by duPont under the trade-mark "Delrin".

The body 21 defines a generally rectangular upper portion and a generally semi-circular bottom portion which conforms generally to the configuration of the tape roll 13. The body 21 is comprised of a planar back wall 27, an outer wall 29 extending normally of the back wall about the periperhal edge of the back wall and a central spindle 31. The wall 27 extends slightly beyond the outer wall to form a flange 32.

The spindle 31 includes a series of annular steps 33 adjacent the back wall 27. The spool 15 is provided with cooperatively shaped annular reliefs 35 which cooperatively overly the steps 33. This relationship between the spindle 33 and spool 15 makes it necessary to insert replacement spools into the chamber 25 in only one direction. In this way unwinding of the tape from the spool in the most functionally advantageous manner is assured.

The outer wall 29 includes a pair of oppositely disposed inwardly directed locking tabs 37 which extend beyond the edge of the wall 29 a distance approximately equal to the thickness of the cover 23. These locking tabs engage the cover and retain it in place overlying the chamber 25. The tabs 33 may be manually urged outwardly due to the flexibility of the material forming the body 21. The cover may then be removed to insert another spool 15 of the tape.

The cover 23 defines a generally planar wall having an annular inwardly directed flange which receives the spindle 51. It cooperates with the steps 33 to align the tape spool 15 for proper feed of the tape strip to the advancement arrangement 17. The cover includes a pair of oppositely disposed reliefs 52 which receive the locking tabs 37. The cover further includes a peripheral flange 54 directed generally inwardly toward the flange 32 of the back wall 27 and surrounding the free or open end of the outer wall 29.

The interlocking of the spindle 31 within the flange 51, the locking tabs 33 within the recesses 52 and the outer wall 29 within the surrounding flange 54 provides a rigid and durable container for storage of the tape 13. It is sufficiently structurally sound to serve as a dispensing tool for manual dispensing of the tape. It is further sufficiently rugged to be utilized in combination with a tape applicator tool to comprise a dispensing and application tool to apply tape onto the threads of pipe or conduit. Such combination is particularly shown and described in copending application for United States letter patent Serial No. entitled HAND OPERATED TAPE WRAPPER and filed contemporaneously herewith.

In accordance with the principles of the present invention, the body portion 21 and cover 23 of the tape dispenser form components of the tape advancement arrangement 17 and integrally formed shearing mechanism 19.

As best seen in FIGS. 2 and 6, the body portion 21 includes an integrally formed guide plate 57 cantilevered from the back wall 27. It is connected to the back wall by a web 57 adjacent one end of the guide plate. The remainder of the guide plate is spaced from the back wall and defines a gap 61.

The end of the guide plate 57 connected by web 59 terminates in space relation to the outer wall to define a space 63 for passage of the tape from the chamber 25. The tape passes along the upper surface of the guide plate toward the opposite end of the chamber and toward the shearing mechanism 19.

The opposite end of the guide plate 57 terminates in closely spaced relation to the adjacent portion of the outer wall 29. In this way the guide plate is available to guide the tape strip 13 into operative relationship with the shearing mechanism 19 without interfering with the shearing function.

The cantilevered support of the guide plate 57 and the natural flexibility of the plastic material utilized in making the dispenser 11 permits a certain degree of flexing of the guide plate. This flexing movement is necessary to both the dispensing and severing functions as will be appreciated.

The cover 23 includes an integrally formed actuator 65 which is positioned in overly relation to the guide plate 57 when the dispenser is in an assembled condition. It generally defines the top wall of the dispenser and effectively completes the enclosure for the tape supply 13. Manipulation of the actuator 65 accomplishes operation of the shearing mechanism 19 to sever a length of tape from the stored quantity 13.

The actuator 65 is connected to the cover member 23 by a web 67 adjacent the end of the actuator 65 overlying the space 63 which accommodates passage of the tape 17 from the chamber 25. The remainder of the actuator defines with the cover a gap 69 generally opposite the gap 61 between the guide plate 57 and back wall 27. The flexibility of the material and the cantilevered connection of the actuator 65 to the cover 23 permits limited flexing movement upon manipulation of the actuator. This action accomplishes operation of the shearing mechanism 19.

The tape strip 13 extends between the guide plate 57 and actuator 65 with its free end guided toward the shearing mechanism 19. Each of the guide plate and actuator includes a generally "L" shaped cross section as best seen in FIG. 5.

These two components when positioned in overlying relation define a tape slot 71 having a height and width slightly greater than the thickness and width of the tape 13. This assures free passage of the tape between the guide plate 57 and actuator 65.

Adjacent the free end of the actuator there is provided an enlarged pad 72 adapted to receive thumb pressure during manual operation of the shearing mechanism 19. In use, the dispenser is held in the palm of the hand. The pad 72 is conveniently located for application of pressure upon an angled surface 74 by use of the thumb.

The transverse cross section of the pad 72, best seen in FIG. 5, is such that the pad presents an elevated rounded contour adjacent the back wall 27 and a depressed relatively sharp corner adjacent the cover 23. This construction insures that the user will initiate operation of the shearing mechanism 19 by depression of the actuator by application of force against the portion of the pad adjacent the back wall 27. As will be explained this asymetrical application of force assists in the accomplishment of scissors-like shearing action of the shearing mechanism 19.

Depression of the actuator 65 by application of force upon the pad 72 causes the cantilevered ends of the actuator 65 and guide plate 57 to move inwardly of the chamber 25 toward the spool 15. To prevent excessive flexure and possible breakage of either the guide plate or actuator, stop pins 76 are provided. These pins limit inward movement of the guide plate and actuator.

The actuator 65 includes a cavity 73 formed in the pad 72. The cavity 73 is open to the outer angled surface 74 and also to the tape slot 71.

A rotatable advancement knob 75 is disposed within the cavity 73. It includes oppositely extending stub shafts 77 and an enlarged central knurled portion 79. The stub shafts are loosely and ratatably supported within the cavity by tabs 81. The enlarged knurled portion is exposed to the exterior of the dispenser at the opening in the actuator 65 and is exposed for coation with the tape 13 at the tape slot 71. Manual rotation of the knurled advancement knob 75 in the clockwise direction, as seen in FIG. 2, cuases the knurls to engage the tape strip 13 and advance the strip out beyond the end of the guide plate and out of the dispenser. The looseness of the support provided for retention of the knob 75 within the cavity 73 provides for some vertical movement. Therefore when not depressed against the tape 13 by thumb pressure the knob exerts little or no force upon the tape strip. Once the free end of the tape is advanced out of the dispenser at the shearing mechanism 19, further advancement can be accomplished by manually pulling the tape. The knob will shift vertically in the cavity to preclude interference with the tape.

The shearing mechanism 19 includes a sharp shearing edge surface 83 formed on the actuator 65 and a sharp shearing edge surface 85 formed on the adjacent portion of the outer wall 29. These edge surfaces are disposed generally perpendicularly to each other and when in their free or normal position define an opening 87 through which the tape 13 extends from the dispenser 11.

The sharp shearing edge surface 83 on the free end of the actuator 65 is formed slightly obliquely and consequently overlies the edge surface 85 only slightly adjacent the back wall 27 and almost completely, adjacent the cover 23. (See FIG. 3) The sharp shearing edge surface 85 formed on the end of the outer wall is also formed obliquely. The opening 87 is progressively larger as viewed in FIG. 1 in a direction from the back wall 27 to the cover 23.

A portion of the outer wall 29 adjacent the sharp shearing edge surface is unsupported to allow limited flexure during operation of the shearing mechanism 19. As seen in FIG. 1, the peripheral flange 54 of the cover 23 terminates intermediate the recess 52 and the rectangular edge of the cover to form cutaway 95. As seen in FIG. 4, a similar cutaway 97 is provided in the back wall 29 adjacent the sharp shearing edge surface 85. The portion of the outer wall which is unsupported is free to flex upon depression of the actuator 65.

As best seen in FIGS. 2 and 4, the outer wall 29 is provided with a retainer which extends from the sharp shearing edge surface 85 and surrounds a portion of the sharp shearing edge surface 83 of the actuator 65 adjacent the back wall 27. The retainer defines a stop tab 91 which limits upward movement of the actuator 65. This relationship precludes accidental flexing of the actuator in a direction away from the guide plate 27 which might cause breakage of the actuator. It additionally maintains the sharp shearing edge surfaces 83 and 85 in operative relation to effect a scissors-like shearing action transversely across the tape strip upon depression of the actuator 65.

The retainer 89 includes an angled cam surface 93 shown in FIGS. 2 and 4. When the body 21 and cover 23 are assembled the sharp shearing edge surface 83 of the actuator 65 overlies this cam surface. Depression of the actuator 65 causes the sharp shearing edge surface 83 to exert a camming force against the cam surface 93. This causes flexure of the unsupported portion of the outer wall 89 away from the sharp shearing edge surface 83. This initiates a restoring force which tends to urge the two sharp shearing edge surfaces into contact.

Continued depression of the actuator 65 brings the sharp shearing edge surface 83 and 85 into point contact immediately adjacent the retainer 89. This point contact is also immediately adjacent one longitudinal edge of the tape strip 13. Further depression of the actuator 65 causes the point contact between the sharp shearing edge surfaces 83 and 85 to progress across the surfaces toward the cover 23. It also causes further flexure of the unsupported portion of the outer wall away from the descending sharp edge surface 83 of the actuator 65 progressively increasing the force which maintains the surface 83 and 85 in point contact. This progression causes a scissors-like shearing action across the tape 13 and affects severance of a length of tape from the stored quantity. Excessive depression of the actuator is precluded by contact of the guide plate 57 with the stop pins 76.

Upon release of the actuator, the flexible nature of the material forming the body 27 and cover 23 cause the actuator and guide plate to return to their initial neutral positions. Similarly, as the point contact of the sharp shearing edge surfaces 83 and 85 progresses toward the retainer 89 the unsupported outer wall portion flexes back to its initial position. The portion of the sharp shearing edge surface 83 adjacent the back wall 29 rests in the retainer 89 in overlying relation to the cam surface 93 and the forces causing flexure of the unsupported portion of the outer wall are relieved. The shearing mechanism 19 again defines an opening 87 for subsequent dispensing of tape.

With the above relationship between the camming surface 93 and sharp shearing edge surface 83, initial flexing of the unsupported portion of the outer wall is initiated prior to point contact between the shearing edge surfaces. Thus a biasing force urging the two surfaces into contact is established prior to initial shearing of the tape. Similarly when not in use, the position of the sharp shearing edge surface 83 in the retainer 93 relieves all forces acting to flex the unsupported wall away from the shearing edge surface 83. Thus there is no tendency of the wall to lose its resilence due to "permanent set" caused by constant application of a flexing force.

The guide plate 57 is formed such that upon assembly of the cover 23 and body 21 the actuator is urged in a direction toward the stop tab 91 of the retainer 89. This biasing of the actuator 65 insures return of the components of the shearing mechanism 19 to the ready position upon completion of shearing action. Also the guide plate 57 is positioned with respect to the sharp shearing edge surface 85 formed on the unsupported outer wall 29 such that the tape slot 71 is in alignment with the opening 87. This allows free egress of the end of the tape 13 upon manipulation of the knurled advancement knob 79.

It should also be noted that the tape 13 is wound upon the spool 15 in one direction and that it is generally doubled back in the opposite direction it passes through the space 63 and along the tape slot 71. It is contemplated that this arrangement will take advantage of the natural tendency of the tape to "curl" or return to its wound position. This "memory" or natural elasticity of the tape will insure that the free end of the tape strip will travel along the under surface of the actuator 65 and out the opening 87. It will oppose any tendency of the tape end to pass between the free end of the guide plate 57 and outer wall 29.

Various features of the present invention have been particularly shown and described in connection with the illustrated embodiments. However, it must be understood that various modifications may be made without departing from the spirit and scope of the invention.

What is claimed is:

1. A dispenser for shearable material comprising:

a chamber defining housing for receiving a quantity of material in the form of a rolled strip, said housing including means defining an opening to allow egress of the material from the chamber;

advancement means operable to advance the strip of material out of said chamber through the opening; and a shearing mechanism integrally formed on said housing said shearing mechanism including a pair of sharp shearing edge surfaces disposed to receive the strip material therebetween and being movable to produce point contact between said sharp shearing edge surfaces progressively thereacross to effect shearing of the interposed strip of material.

2. A dispenser as claimed in claim 1 wherein:

said advancement means includes, a guide plate to support a portion of the strip material; and a rotatable knob supported by said housing in overlying relation to the guide plate and the strip of material, said knob being actuable to engage the strip of material and effect advancement of the material out of the opening in said housing.

3. A dispenser as claimed in claim 1 wherein:

said housing includes a body and a removable cover;

said body includes a spindle to rotatably support a quantity of strip material wound upon a spool;

said body includes an outer wall having a pair of oppositely disposed locking tabs to releasably engage said cover to retain said cover on said body and wherein;

said cover defines an annular inwardly directed flange, said spindle of said body being disposed therein;

said cover further includes a peripheral flange cooperatively engaging said outer wall of said body.

4. A dispenser as claimed in claim 1:

wherein said housing includes an integrally formed actuator having an end defining one of said sharp shearing edge surfaces said actuator being flexible and operable to effect said progressing point contact of said shearing edge surfaces.

5. A dispenser as claimed in claim 4 wherein:

said housing includes an unsupported wall portion defining said other of said sharp shearing edge surfaces;

said unsupported wall portion being flexible upon operation of said actuator to provide a biasing force urging said sharp shearing edge surfaces into said progressive point contact.

6. A dispenser as claimed in claim 5 wherein:

said unsupported wall portion includes a cam surface;

said sharp shearing edge surface of said actuator being disposed to engage said cam surface to flex said unsupported wall prior to establishment of said point contact between said sharp shearing edge surfaces to initiate said biasing force to urge said sharp shearing edge surfaces into said point contact.

7. A dispenser as claimed in claim 6 wherein:

said sharp shearing edge surfaces are disposed generally at 90° to each other;

the sharp shearing edge surfaces of said actuator being formed obliquely to overly said sharp shearing edge surface of said unsupported portion of said wall a progressively increasing amount in a direction away from said cam surface.

8. A dispenser as claimed in claim 7 wherein:

said sharp shearing edge surface of said unsupported wall portion is formed obliquely to define with said end of said actuator forming said other of said sharp shearing edge surfaces an opening of progressively increasing size in a direction away from said cam surface.

9. A dispenser as claimed in claim 5 wherein:

said housing includes a body and a removable cover;

said body includes a tape guide cantilevered thereon for guiding the strip material to said opening;

said actuator being cantilevered from said cover in overlying relation to said tape guide and having an advancement means supported therein;

said advancement means being operable to engage strip material and advance said material out of said opening;

operation of said actuator causing flexure of said tape guide during said progressive point contact of said sharp shearing edge surfaces, release thereof allowing said flexed tape guide to return to its original position to allow subsequent advancement of the strip material from said opening.

10. A dispenser as claimed in claim 9 wherein said unsupported wall portion includes:

a cam surface;

said sharp shearing edge surface of said actuator being disposed to engage said cam surface to flex said unsupported wall prior to establishment of said point contact between said sharp shearing edge surfaces to initiate said biasing force to urge said sharp shearing edge surfaces into said point contact; and said unsupported wall further defining a retainer limiting movement of said actuator and said tape guide in a direction away from said unsupported wall portion.

* * * * *